US009551341B2

(12) United States Patent
Kanemoto et al.

(10) Patent No.: US 9,551,341 B2
(45) Date of Patent: Jan. 24, 2017

(54) SCROLL TYPE FLUID MACHINE WITH ECCENTRIC BUSH

(71) Applicant: Hitachi Industrial Equipment Systems Co., Ltd., Chiyoda-ku, Tokyo (JP)

(72) Inventors: Yoshiyuki Kanemoto, Tokyo (JP); Atsushi Kanaizumi, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 14/324,804

(22) Filed: Jul. 7, 2014

(65) Prior Publication Data

US 2015/0093276 A1 Apr. 2, 2015

(30) Foreign Application Priority Data

Sep. 30, 2013 (JP) ..... 2013-203005

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/02*** | (2006.01) |
| ***F01C 1/02*** | (2006.01) |

(Continued)

(52) U.S. Cl.

CPC ..... *F04C 18/0215* (2013.01); *F01C 1/0215* (2013.01); *F01C 21/02* (2013.01); *F04C 29/0057* (2013.01); *F04C 29/0071* (2013.01); *F04C 23/008* (2013.01); *F04C 2240/56* (2013.01); *F04C 2240/807* (2013.01)

(58) Field of Classification Search

CPC . F04C 18/0215; F04C 23/008; F04C 29/0021; F04C 29/0057; F04C 29/0071; F04C 2240/56; F04C 2240/807; F01C 21/02; F01C 1/0215

USPC ..... 418/55.1–55.6, 57, 151, 180

See application file for complete search history.

(56) References Cited

U.S. PATENT DOCUMENTS 5,141,422 A 8/1992 Ito et al.
5,165,879 A * 11/1992 Kondo ..... F04C 29/0057 418/57

(Continued)

FOREIGN PATENT DOCUMENTS

CN 1059190 A 3/1992
CN 101469704 A 7/2009

(Continued)

OTHER PUBLICATIONS

JP 2001-123969A_(English Translation)—Fujioka et al., Scroll Fluid Machine, Aug. 5, 2001.*

(Continued)

*Primary Examiner* — Theresa Trieu
(74) *Attorney, Agent, or Firm* — Crowell & Moring LLP

(57) ABSTRACT

A scroll type fluid machine, for improving a dimensional accuracy with easy working, includes a fixed scroll, an orbiting scroll arranged so as to oppose to the fixed scroll and executing an orbiting motion, a driving shaft driving the orbiting scroll, an eccentric shaft decentered from the driving shaft and connected to the orbiting scroll, and an eccentric bush connecting the driving shaft and the eccentric shaft to each other, in which the eccentric bush includes a main hole into which the driving shaft is fitted and an eccentric hole into which the eccentric shaft is fitted, and the eccentric hole is decentered with respect to the main hole.

16 Claims, 5 Drawing Sheets

(51) Int. Cl.

| | |
|---|---|
| ***F04C 29/00*** | (2006.01) |
| ***F01C 21/02*** | (2006.01) |
| *F04C 23/00* | (2006.01) |

(56) References Cited

U.S. PATENT DOCUMENTS

| | | | | |
|---|---|---|---|---|
| 5,366,360 | A | 11/1994 | Bookbinder et al. | |
| 5,536,152 | A * | 7/1996 | Kawahara et al. | 418/55.5 |
| 7,455,508 | B2 * | 11/2008 | Suefuji | F04C 29/0057 418/57 |
| 8,096,792 | B2 * | 1/2012 | Suefuji et al. | 418/55.5 |
| 2009/0110580 | A1 | 4/2009 | Suefuji et al. | |

FOREIGN PATENT DOCUMENTS

| | | | |
|---|---|---|---|
| CN | 103089619 | A | 5/2013 |
| JP | 2001-123969 | A | 5/2001 |
| JP | 2002-285979 | A | 10/2002 |
| JP | 2010-043608 | A | 2/2010 |
| JP | 2012-132346 | A | 7/2012 |
| WO | WO 2013/104980 | A1 | 7/2013 |

OTHER PUBLICATIONS

Belgian Search Report (PCT/ISA/210) dated Oct. 29, 2014 with partial English-language translation (four (4) pages).

Belgian Written Opinion (PCT/ISA/237) dated Oct. 29, 2014 (four (4) pages).

Korean-language Office Action issued in counterpart Korean Application No. 10-2014-0065659 dated Sep. 14, 2015 with partial English translation (Six (6) pages).

Chinese Office Action issued in counterpart Chinese Application No. 201410331111.0 dated May 4, 2016 with partial English-language translation (eight (8) pages).

* cited by examiner

SCROLL TYPE FLUID MACHINE WITH ECCENTRIC BUSH

INCORPORATION BY REFERENCE

The present application claims priority from Japanese application JP 2013-203005 filed on Sep. 30, 2013, the content of which is hereby incorporated by reference into this application.

BACKGROUND OF THE INVENTION

1. Field of the Invention

The present invention relates to a scroll type fluid machine.

2. Description of Related Art As the related art in the technical field of the present invention, JP 2001-123969 A and JP 2012-132346 A can be cited.

In JP 2001-123969 A, a scroll type fluid machine is described in which an eccentric bush including a retaining tube and an eccentric shaft is provided and a distal end of a driving shaft is inserted to the retaining tube.

In JP 2012-132346 A, a scroll type compressor is described which includes a revolving mechanism that comprises an eccentric shaft, a bush and an Oldham ring, and a driving shaft that imparts a revolving force to the revolving mechanism.

The eccentric bush of JP 2001-123969 A is formed integrally with the eccentric shaft. Therefore, it was hard to bore a hole into which the driving shaft is inserted with a high degree of accuracy with respect to a position of the eccentric shaft, and the dimensional accuracy of the eccentricity amount could not be improved.

In the eccentric bush arranged in the revolving mechanism of JP 2012-132346 A, although the eccentric shaft is fitted, the driving shaft is not fitted, and the eccentric shaft is made eccentric with respect to the driving shaft by boring a hole for fitting the eccentric shaft in the driving shaft. It was hard to bore a hole at a highly accurate position with respect to the driving shaft, and the dimensional accuracy could not be improved.

SUMMARY OF THE INVENTION

In view of the problems described above, the object of the present invention is to provide a scroll type fluid machine including an eccentric bush capable of improving the dimensional accuracy with easy working.

In order to solve the problems described above, the present invention provides "a scroll type fluid machine including a fixed scroll, an orbiting scroll arranged so as to oppose to the fixed scroll and executing an orbiting motion, a driving shaft driving the orbiting scroll, an eccentric shaft decentered from the driving shaft and connected to the orbiting scroll, and an eccentric bush connecting the driving shaft and the eccentric shaft to each other, in which the eccentric bush includes a main hole in which the driving shaft is fitted and an eccentric hole into which the eccentric shaft is fitted, the main hole and the eccentric hole are through holes, and one hole thereof is formed at a position not projecting outward in the radial direction from the other hole thereof as viewed from the direction the driving shaft extends".

According to the present invention, a scroll type fluid machine can be provided which includes an eccentric bush capable of improving the dimensional accuracy with easy working.

Other objects, configurations, and advantageous effects of the invention will become apparent from the following description of the embodiments of the invention taken in conjunction with the accompanying drawings.

DETAILED DESCRIPTION OF THE INVENTION

[Embodiment 1]

Embodiment 1 according to the present invention will be described with reference to FIGS. 1-6 below.

Figure 1:
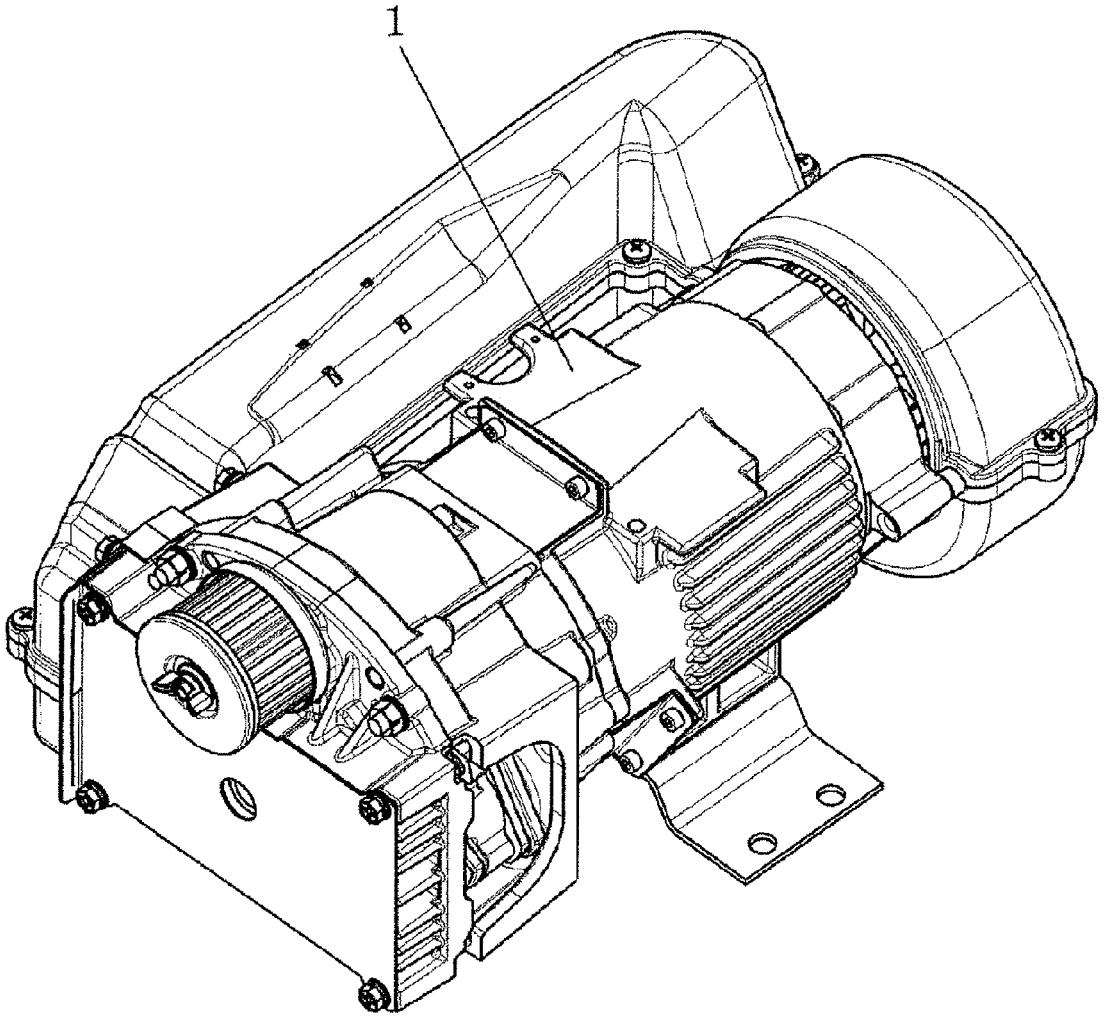
FIG. 1 is a drawing showing an appearance of a compressor according to Embodiment 1 of the present invention.
Figure 2A:
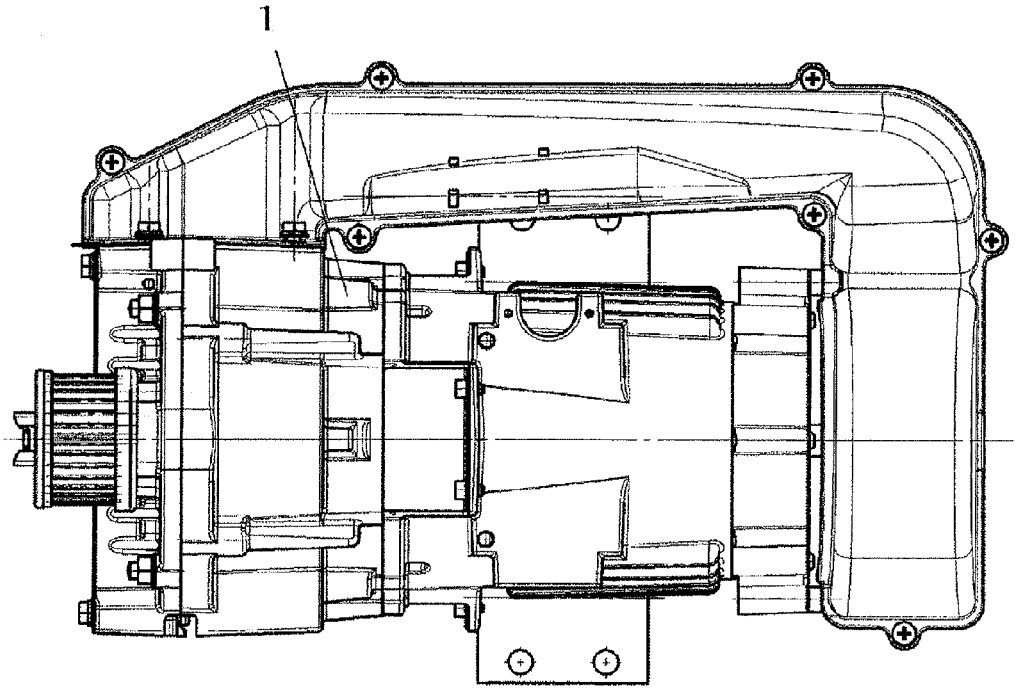
FIG. 2A and FIG. 2B are drawings showing an internal structure of the compressor according to Embodiment 1 of the present invention.
Figure 2B:
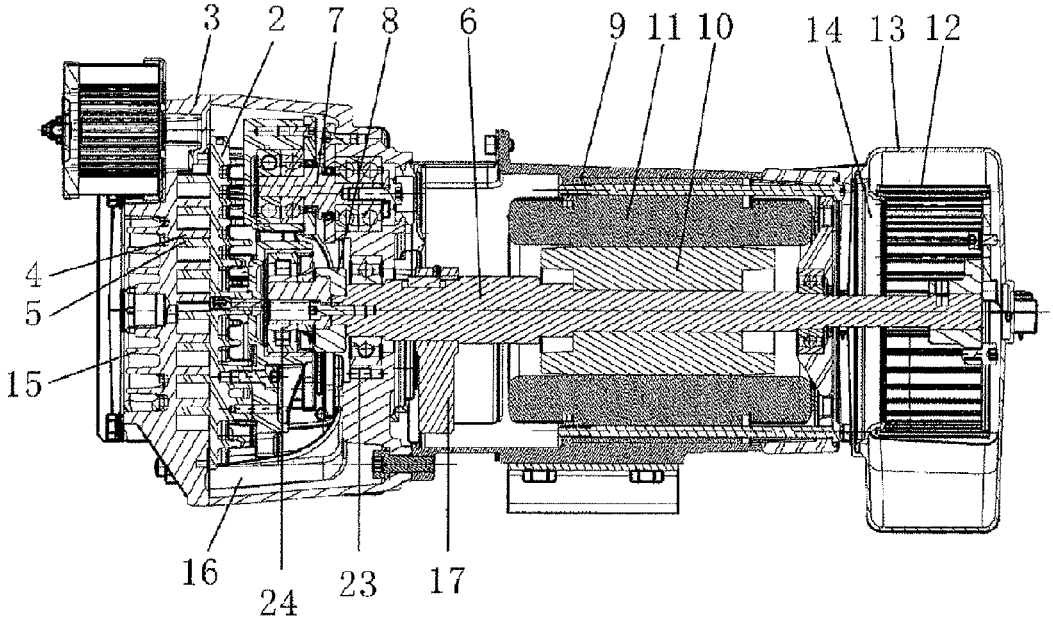

FIG. 1, FIG. 2A and FIG. 2B are overall structural drawings of a scroll type compressor according to Embodiment 1 of the present invention.

In a compressor main body 1, an orbiting scroll 2 and a fixed scroll are arranged so as to oppose to each other, and a compression chamber is formed by lap sections 4, 5 of a spiral shape erected respectively on the surfaces of the orbiting scroll 2 and the fixed scroll 3 opposing to each other. Also, an eccentric section (eccentric bush 8) is arranged on the compressor main body side of a driving shaft 6, and an eccentric shaft 18 arranged so as to be eccentric relative to the driving shaft 6 is connected to the driving shaft 6 by the eccentric bush 8. The eccentric shaft 18 is connected to the orbiting scroll 2 and rotatively drives the orbiting scroll 2. Also, a rotation prevention mechanism 7 is arranged in the orbiting scroll 2, and the orbiting scroll 2 executes a rotating (eccentric) motion with respect to the fixed scroll 3 by the driving shaft 6 so as to compress air.

Here, a motor driving the compressor main body 1 is constituted of a motor casing 9 and a rotor 10 and a stator 11 accommodated therein, and is connected to the driving shaft 6 that is penetratingly attached to a rotor 10. Also, on the side of the driving shaft 6 opposite to the orbiting scroll 2, a cooling fan 12 generating cooling air is attached. The cooling fan 12 is accommodated in a fan casing 13 that is attached to the motor casing 9, the motor is driven, the cooling fan thereby rotates, and cooling gas is sucked from a cooling air inlet 14, so as to generate the cooling air. The cooling air generated by the cooling fan 12 passes through inside the fan casing 13, flows to the side of the orbiting scroll 2 and a cooling fin 15 on the back of the fixed scroll 3, and cools the compressor main body 1. The cooling air having cooled the compressor main body 1 and having been warmed is discharged from a cooling air outlet 16.

Figure 3:
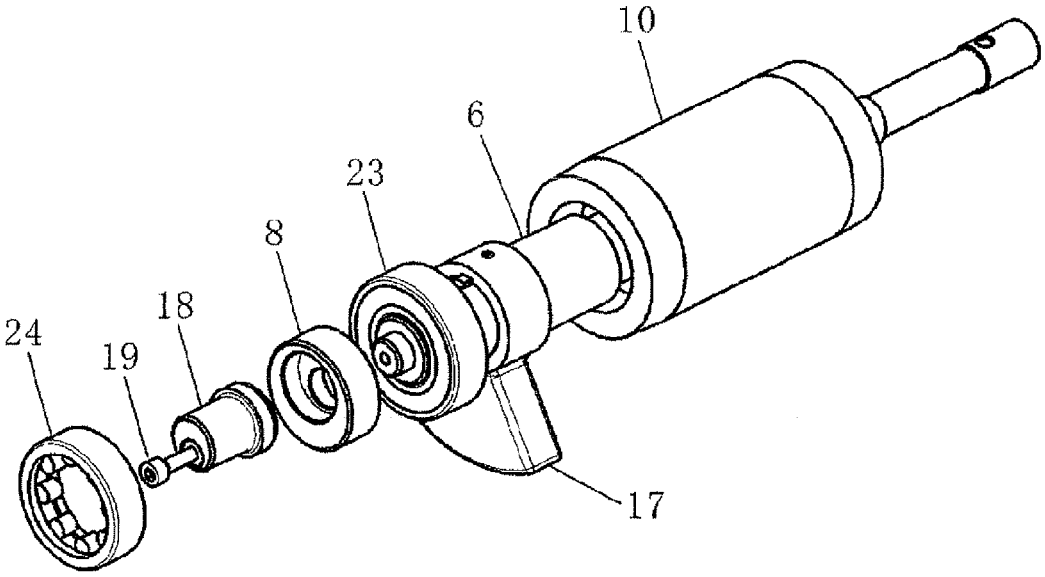
FIG. 3 is a drawing showing a parts configuration of a driving shaft according to Embodiment 1 of the present invention.

FIG. 3 is a configuration drawing of the eccentric bush 8 and the driving shaft 6. On the driving shaft 6, a balance weight 17 adjusting the weight balance with respect to the eccentric motion is arranged, and the eccentric bush 8 and the eccentric shaft 18 are disposed in this order. Also, the eccentric bush 8 and the eccentric shaft 18 are fixed to the driving shaft 6 by a fixing bolt 19.

The driving shaft 6 is supported by a main bearing 23, and the main bearing 23 is arranged between the balance weight 17 and the eccentric bush 8. Also, the eccentric shaft 18 is supported by an eccentric bearing 24, and the eccentric bearing 24 is arranged between the orbiting scroll 2 and the eccentric bush 8. With such positional relation, the balance weight 17, the main bearing 23, the eccentric bush 8, the eccentric shaft 18 and the eccentric bearing 24 can be assembled onto the driving shaft 6 in this order, and assembling can be executed easily from one direction.

Figure 4:
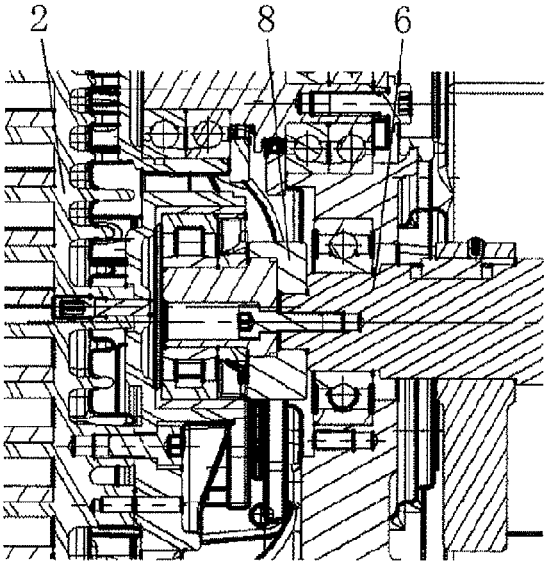
FIG. 4 is an enlarged view of a parts configuration according to Embodiment 1 of the present invention.
Figure 5A:
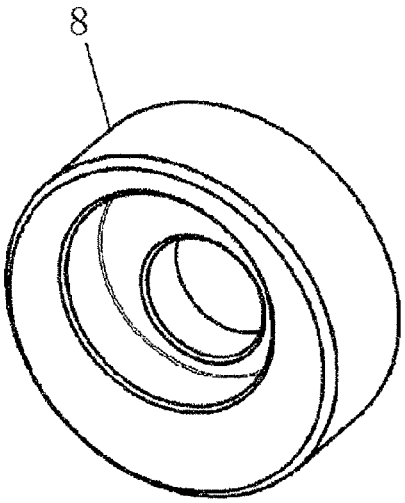
FIG. 5A and FIG. 5B are enlarged views of an eccentric bush according to Embodiment 1 of the present invention.
Figure 5B:
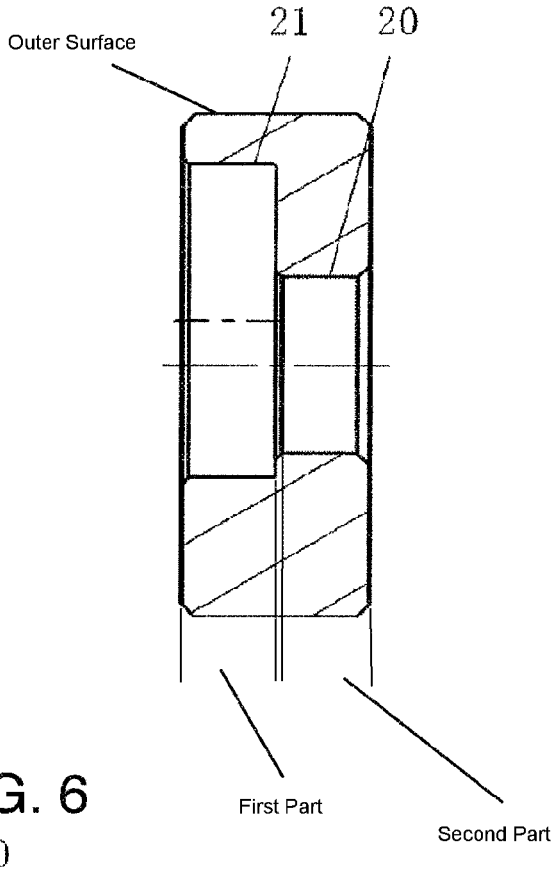

FIG. 4, FIG. 5A and FIG. 5B are enlarged views of the eccentric bush 8 of the present embodiment. The eccentric bush 8 is arranged on the compressor main body side of the driving shaft 6, and is connected to the orbiting scroll 2, so as to revolvingly drive the orbiting scroll 2. The eccentric bush 8 has a main hole 20 into which the driving shaft 6 is fitted and an eccentric hole 21 into which the eccentric shaft 18 is fitted, and the eccentric hole 21 is decentered with respect to the main hole 20. Thus, the orbiting scroll 2 executes an orbiting motion with respect to the fixed scroll 3. In the present embodiment, the driving shaft 6 and the eccentric shaft 18 are not subjected to boring work, but the eccentric shaft 18 is decentered to the driving shaft 6 by means of the eccentric bush 8. Thus, highly accurate boring work is not required for the driving shaft 6 and the eccentric shaft 18, and the dimensional accuracy can be improved with easy working. Also, the weight of the balance weight 17 is arranged on the opposite side to the eccentricity direction of the eccentric hole 21 with respect to the main hole 20. Thus, the weight balance with respect to the eccentric motion can be adjusted.

As shown in FIG. 5A and FIG. 5B, the eccentric bush 8 is penetrated by the main hole 20 and the eccentric hole 21. Also, the main hole 20 and the eccentric hole 21 are formed at a position where one thereof does not protrude from the other thereof outward in the radial direction. Because the main hole 20 and the eccentric hole 21 are in such positional relation, when forming them, the main hole 20 and the eccentric hole 21 can be manufactured by working from one direction. In working the main hole 20 and the eccentric hole 21 from one direction, since it is enough to fix the raw material to a work machine only once, the displacement of the main hole 20 and the eccentric hole 21 caused by positioning and the like in working can be reduced, and the accuracy of finishing can be improved easily. FIG. 5B further shows an outer surface of a first part of the eccentric bush 8 into which the eccentric shaft is fitted as not decentered with respect to an outer surface of a second part of the eccentric bush into which the driving shaft is fitted.

Figure 6:
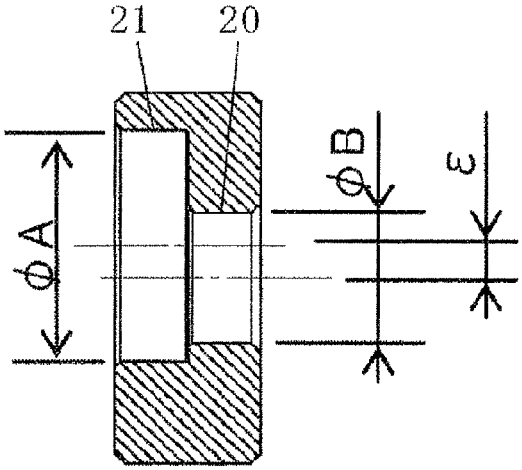
FIG. 6 is a drawing showing a relation between diameters of the main hole and the eccentric hole and the eccentricity amount according to Embodiment 1 of the present invention.

Here, the relation between the diameters of the main hole 20 and the eccentric hole 21 and the eccentricity amount is shown in FIG. 6. When the diameter of one of the respective holes is made A, the diameter of the other is made B, and the eccentricity amount of the orbiting scroll is made $\epsilon$, by achieving the relation of $(A/2-\epsilon)>B/2$, the main hole 20 and the eccentric hole 21 can be formed at a position where one thereof does not protrude from the other thereof outward in the radial direction.

In the scroll type compressor, because the compression chamber is formed by the lap sections 4, 5 of the orbiting scroll 2 and the fixed scroll 3, the performance of the compressor depends to the size of the gap between the laps. As the gap between the laps is smaller, the sealing degree of the compression chamber increases, and the performance improves. However, when the laps contact each other, the laps come to be broken, and the compressor breaks down. Therefore, the accuracy of the eccentric section determining the gap between the laps becomes important in the performance and reliability of the compressor. According to the present embodiment, because the main hole 20 into which the driving shaft 6 is fitted and the eccentric hole 21 into which the eccentric shaft 18 is fitted are arranged in the eccentric bush 8, the dimensional accuracy can be improved with easy working. Thus, the performance and reliability of the compressor can be improved.

[Embodiment 2]

Embodiment 2 according to the present invention will be described using FIG. 7, FIG. 8A and FIG. 8B. With respect to the configuration same as that of Embodiment 1, same reference signs will be given and description thereof will be omitted.

Figure 7:
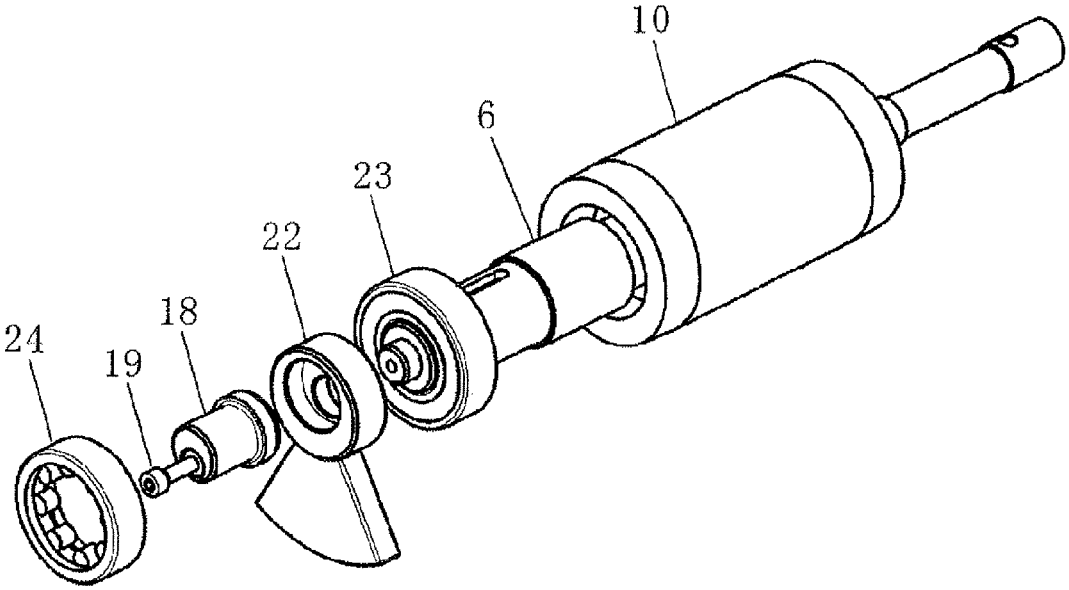
FIG. 7 is a drawing showing a parts configuration of a driving shaft according to Embodiment 2 of the present invention.

As shown in FIG. 7, in the present embodiment, the eccentric bush 8 and the balance weight 22 adjusting the weight balance of the eccentric shaft 18 explained in Embodiment 1 are formed integrally. The balance weight 22 is necessary for adjusting the weight balance with respect to the eccentric motion of the orbiting scroll 2, and is disposed on the main shaft side.

Figure 8A:
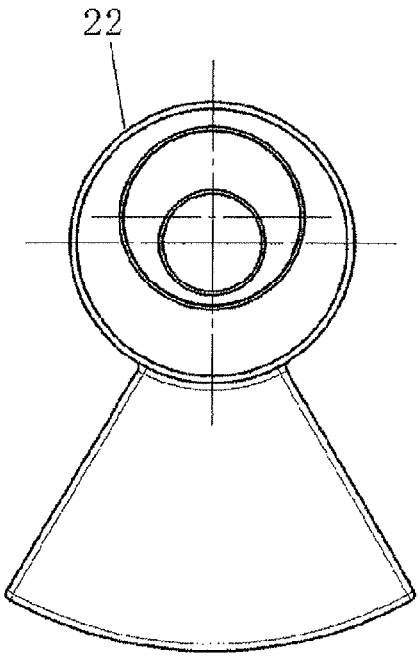
FIG. 8A and FIG. 8B are enlarged views of a balance weight according to Embodiment 2 of the present invention.
Figure 8B:
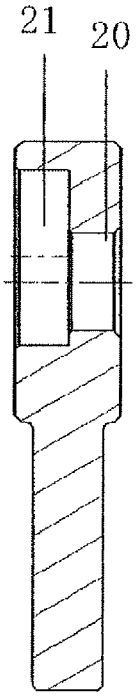

FIG. 8A and FIG. 8B are enlarged views of the present embodiment. As shown in the drawings, in the present embodiment, the eccentric bush 8 and the balance weight 22 are formed integrally. The main hole 20 and the eccentric hole 21 are formed in the balance weight 22 (eccentric bush 8). Also, the weight of the balance weight is formed on the opposite side of the direction where the eccentric shaft 18 is decentered (the direction where the eccentric hole 21 is decentered with respect to the main hole 20). Thus, even in the case that the eccentric bush 8 and the balance weight 22 are formed integrally, the weight balance with respect to the eccentric motion can be adjusted.

Also, in the present embodiment, the main bearing 23 supporting the driving shaft 6 is arranged between the eccentric bush 8 (balance weight 22) and the motor casing 9. With such positional relation, the main bearing 23, the eccentric bush 8 (balance weight 22), the eccentric shaft 18 and the eccentric bearing 24 can be assembled onto the driving shaft 6 in this order, and assembling can be executed easily from one direction.

According to the present embodiment, because parts assembled onto the driving shaft 6 can be reduced, assembling can be simplified, the length of the driving shaft 6 can be shortened, and therefore the product can be miniaturized also.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A scroll type fluid machine, comprising:

a fixed scroll;

an orbiting scroll arranged so as to oppose to the fixed scroll and executing an orbiting motion;

a driving shaft driving the orbiting scroll;

an eccentric shaft decentered from the driving shaft and connected to the orbiting scroll;

an eccentric bush connecting the driving shaft and the eccentric shaft to each other; and a fixing bolt fixing the eccentric bush and the eccentric shaft to the driving shaft, wherein the eccentric bush has a main hole into which the driving shaft is fitted and an eccentric hole into which the eccentric shaft is fitted, and the eccentric hole is decentered with respect to the main hole.

2. The scroll type fluid machine according to claim 1, wherein the main hole and the eccentric hole penetrate the eccentric bush.

3. The scroll type fluid machine according to claim 1, wherein the main hole and the eccentric hole are formed at positions so that one of the main and eccentric holes does not protrude from the other of the main and eccentric holes outward in a radial direction as viewed in a direction where the driving shaft extends.

4. The scroll type fluid machine according to claim 1, wherein, when a diameter of one of the main hole and the eccentric hole is made A, a diameter of the other is made B, and an eccentricity amount of the orbiting scroll is made $\epsilon$, $(A/2-\epsilon)>B/2$ is achieved.

5. The scroll type fluid machine according to claim 1, wherein the eccentric bush and a balance weight that adjusts weight balance of the eccentric shaft are formed integrally.

6. The scroll type fluid machine according to claim 1, wherein a main bearing supporting the driving shaft is arranged between the eccentric bush and a balance weight that adjusts weight balance of the eccentric shaft.

7. The scroll type fluid machine according to claim 1, wherein an eccentric bearing supporting the eccentric shaft is arranged between the eccentric bush and the orbiting scroll.

8. The scroll type fluid machine according to claim 1, wherein an outer surface of a first part of the eccentric bush into which the eccentric shaft is fitted is not decentered with respect to an outer surface of a second part of the eccentric bush into which the driving shaft is fitted.

9. A scroll type fluid machine, comprising:

a fixed scroll;

an orbiting scroll arranged so as to oppose to the fixed scroll and executing an orbiting motion;

a driving shaft driving the orbiting scroll;

an eccentric shaft decentered from the driving shaft and connected to the orbiting scroll;

an eccentric bush in which a main hole into which the driving shaft is fitted and an eccentric hole into which the eccentric shaft is fitted are arranged; and a fixing bolt fixing the eccentric bush and the eccentric shaft to the driving shaft, wherein the eccentric shaft is decentered with respect to the driving shaft by decentering the eccentric hole with respect to the main hole.

10. The scroll type fluid machine according to claim 9, wherein the main hole and the eccentric hole penetrate the eccentric bush.

11. The scroll type fluid machine according to claim 9, wherein the main hole and the eccentric hole are formed at positions so that one of the main and eccentric holes does not protrude from the other of the main and eccentric holes outward in a radial direction as viewed in a direction where the driving shaft extends.

12. The scroll type fluid machine according to claim 8, wherein, when a diameter of one of the main hole and the eccentric hole is made A, a diameter of the other is made B, and an eccentricity amount of the orbiting scroll is made $\epsilon$, $(A/2-\epsilon)>B/2$ is achieved.

13. The scroll type fluid machine according to claim 9, wherein the eccentric bush and a balance weight that adjusts weight balance of the eccentric shaft are formed integrally.

14. The scroll type fluid machine according to claim 9, wherein a main bearing supporting the driving shaft is arranged between the eccentric bush and a balance weight that adjusts balance of the eccentric shaft.

15. The scroll type fluid machine according to claim 9, wherein an eccentric bearing supporting the eccentric shaft is arranged between the eccentric bush and the orbiting scroll.

16. The scroll type fluid machine according to claim 9, wherein an outer surface of a first part of the eccentric bush into which the eccentric shaft is fitted is not decentered with respect to an outer surface of a second part of the eccentric bush into which the driving shaft is fitted.

* * * * *